US009493960B2

(12) United States Patent
Spicer et al.

(10) Patent No.: US 9,493,960 B2
(45) Date of Patent: Nov. 15, 2016

(54) COVER ASSEMBLY FOR A SPA

(71) Applicant: Strong Industries, Northumberland, PA (US)

(72) Inventors: Wade Spicer, Northumberland, PA (US); Ryan Force, Nescopeck, PA (US)

(73) Assignee: STRONG INDUSTRIES, INC., Northumberland, PA (US)

( * ) Notice: Subject to any disclaimer, the term of this patent is extended or adjusted under 35 U.S.C. 154(b) by 102 days.

(21) Appl. No.: 14/159,710

(22) Filed: Jan. 21, 2014

(65) Prior Publication Data

US 2014/0201898 A1 Jul. 24, 2014

Related U.S. Application Data

(60) Provisional application No. 61/755,060, filed on Jan. 22, 2013.

(51) Int. Cl.
*E04H 4/00* (2006.01)
*E04H 4/08* (2006.01)

(52) U.S. Cl.
CPC ..... *E04H 4/084* (2013.01)

(58) Field of Classification Search
CPC E04H 4/084; Y10T 16/542; Y10T 16/53885
USPC ..... 4/498–503
See application file for complete search history.

(56) References Cited

U.S. PATENT DOCUMENTS 4,853,985 A 8/1989 Perry
5,398,350 A * 3/1995 Watkins ..... E04H 4/08 4/498
5,819,332 A * 10/1998 Perry ..... E04H 4/084 4/496
5,950,252 A * 9/1999 Fettes ..... E04H 4/084 4/498
5,974,600 A * 11/1999 Pucci ..... E04H 4/084 4/498
6,000,071 A * 12/1999 Fettes ..... E04H 4/084 4/498
6,032,305 A * 3/2000 Tedrick ..... E04H 4/084 220/817
6,381,766 B1 * 5/2002 Perry ..... E04H 4/084 16/239
6,393,630 B1 * 5/2002 Tedrick ..... E04H 4/084 4/498
6,442,799 B1 * 9/2002 Duarte ..... E04H 4/084 16/277
6,859,952 B2 * 3/2005 Perry ..... E04H 4/084 4/498
2003/0150054 A1 8/2003 Tudor
2007/0256229 A1 * 11/2007 Duarte ..... E04H 4/084 4/498

OTHER PUBLICATIONS

PCT/US2014/012281; International Search Report and Written Opinion dated May 14, 2014.

* cited by examiner

*Primary Examiner* — Erin Deery
(74) *Attorney, Agent, or Firm* — Grogan, Tuccillo & Vanderleeden, LLP

(57) ABSTRACT

A cover assembly for a spa having a base and a shell supported by the base is provided. The cover assembly includes a cover member selectively movable between a covered position and an uncovered position, and a lifting assembly having a first lifting mechanism rotatably coupled to the cover member and to the base. The first lifting mechanism provides two axes of rotation for the cover member relative to the base.

17 Claims, 13 Drawing Sheets

COVER ASSEMBLY FOR A SPA

This application claims the benefit of U.S. Provisional Application Ser. No. 61/755,060, filed on Jan. 22, 2013, which is herein incorporated by reference in its entirety.

FIELD OF THE INVENTION

The present invention relates generally to spas and, more particularly, to a cover assembly for a spa.

BACKGROUND OF THE INVENTION

Spas, also commonly known as hot tubs, are popular fixtures that are used in many homes. They generally include a deep, vacuum formed tub having a smooth acrylic liner that is filled with heated water and which is used for soaking and relaxation. Spas typically include water jets for massage purposes.

Typically, the acrylic liner is formed into shapes that provide a variety of seating arrangements within the tub. Each seat is usually equipped with hydrotherapy jets that allow a pressurized flow of water to be directed at various parts of a user's body. The water flow may be aerated for additional effect, and some or all of the jets may also automatically move or rotate, causing the changing pressure of the water on the body to provide a massage-like effect.

Because many spas/hot tubs are located outdoors, they are often equipped with covers for enclosing the tub when not in use. These covers help prevent dirt, leaves and other debris from entering the water, and provide a safety function by preventing small children and animals from falling into the water. Moreover, spa covers are often insulated so as to limit hear loss from the water when the spa is not in use for purposes of energy efficiency and readiness of use.

As will be readily appreciated, however, existing covers for spas are heavy and cumbersome, making them difficult for a user to remove prior to using the spa and to place back over the spa when it is no longer in use. In addition, existing covers and the mechanisms for removing the covers are prone to breakage.

In view of the above, there remains a need for a cover assembly for a spa that is easier to remove and replace, and which is less prone to breakage.

SUMMARY OF THE INVENTION

It is an object of the present invention to provide a cover assembly for a spa.

It is another object of the present invention to provide a cover assembly for a spa that is easier to remove and replace than existing covers.

It is another object of the present invention to provide a cover assembly for a spa that is less prone to breakage than existing covers.

It is another object of the present invention to provide a cover assembly for a spa that is ergonomic.

It is another object of the present invention to provide a cover assembly for a spa that minimizes the buildup of rainwater, snow and debris.

According to an embodiment of the present invention, a cover assembly for a spa having a base and a shell supported by the base is provided. The cover assembly includes a cover member selectively movable between a covered position and an uncovered position, and a lifting assembly having a first lifting mechanism rotatably coupled to the cover member and to the base. The first lifting mechanism provides two axes of rotation for the cover member relative to the base.

According to another embodiment of the present invention, a spa is provided. The spa includes a base, a shell supported by the base and configured to hold a volume of liquid, a cover member selectively movable between a covered position atop the shell and an uncovered position adjacent to a sidewall of the base, and, a lifting mechanism pivotally coupled to the cover member and to the base. The lifting mechanism provides two axes of rotation for the cover member relative to the base for selectively moving the cover member between the covered position and the uncovered position.

According to yet another embodiment of the present invention, a method of covering and uncovering a spa having a base and a shell supported by the base is provided. The method includes the steps of providing a cover member atop the shell, and equipping the cover member with a lifting mechanism that is pivotally coupled to the cover member and to the base such that the lifting mechanism provides two axes of rotation for the cover member relative to the base for selectively moving the cover member between a covered position atop the shell and an uncovered position adjacent to a sidewall of the base.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENTS

Figure 1:
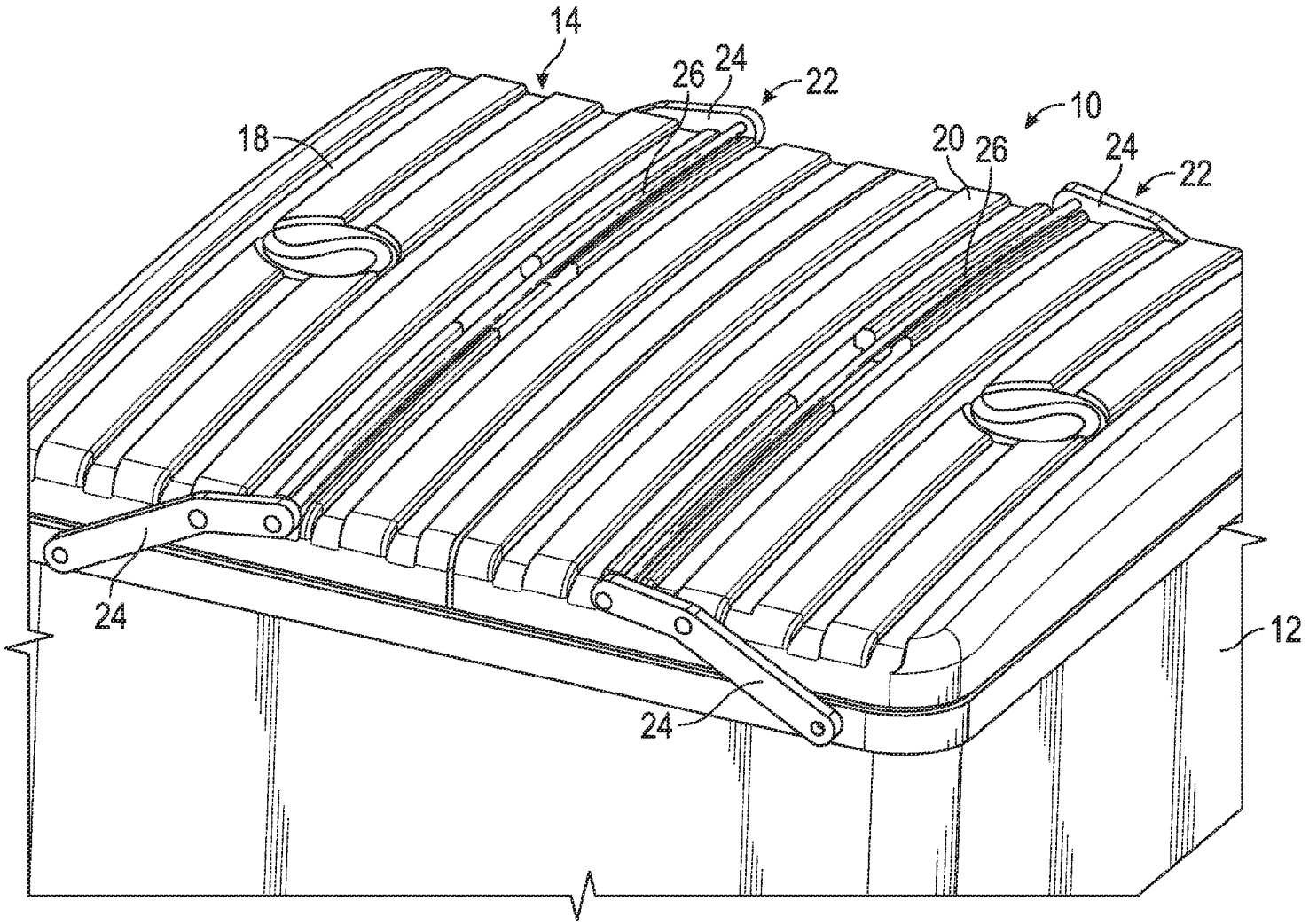
FIG. 1 is a perspective view of a spa having a cover assembly according to an embodiment of the present invention, illustrating the cover assembly in a covered position.

Referring to FIGS. 1-7 a spa 10 having a cover assembly according to an embodiment of the present invention is shown. The spa may be of any type known in the art, and generally includes a base and an acrylic shell supported by the base.

As shown therein, the spa 10 includes a spa cabinet 12 and a cover assembly 14. The spa cabinet 12 serves as the support structure of the spa and may be of any type known in the art, such as framed or sub-frameless. For example, the cabinet 12 may be a sub-frameless spa and may include a pair of end member, a pair of side members, and a base member. In addition, spa 10 includes a spa shell 16 which is preferably formed of acrylic, but may be formed of any suitable plastic material or other impermeable material, and which may be supported by the end members, side members and base member. The spa shell 16 is designed to hold water for use of the spa 10.

As shown therein, the cover assembly 14 includes a first cover member 18 and a second cover member 20. In an embodiment the cover members 18, 20 may be formed from plastic or other material known in the art, and may contain foam or other insulating material to lessen heat loss from the water in the spa 10. Each cover member 18, 20 is pivotally attached to the spa cabinet 12 and is movable between a closed position, in which the cover member 18, 20 rests atop the cabinet 12 and shell 16, and an open position, in which the cover member 18, 20 rests adjacent to the sides of the spa 10 to permit access to the spa 10. In particular, each cover member 18, 20 is pivotally connected to the spa cabinet 12 via a lifter mechanism 22.

As best shown in FIGS. 1-7, the lifter mechanism 22 includes a pair of angled lifter arms 24 rotatably mounted to the cabinet 12 on opposed sides thereof. At an intermediate point along the angled lifter arms 24, the lifter arms 24 are coupled to one of cover members 18, 20. In an embodiment, a coupling rod (not shown) extends through the cover member 18, 20 and connects the angled lifter arms 24 on opposed sides of the spa to one another. As further shown therein, the lifter mechanism 22 also includes a lifter handle 26 that connects the opposed angled lifter arms 24 to one another at distal ends thereof, such that the lifter handle 26 is on an outside of the cover members 18, 20 and accessible to a user. As shown therein, the lifter handle 26 is slightly arcuate in shape.

Importantly, in an embodiment the cover members 18, 20 may rotate or pivot about an axis defined by the coupling rod. In addition, the cover members 18, 20 may rotate about an axis defined by the point where the angled lifter arms 24 are coupled to the spa cabinet 12. In this respect, the cover members 18, 20 each have two points of rotation.

Figure 2:
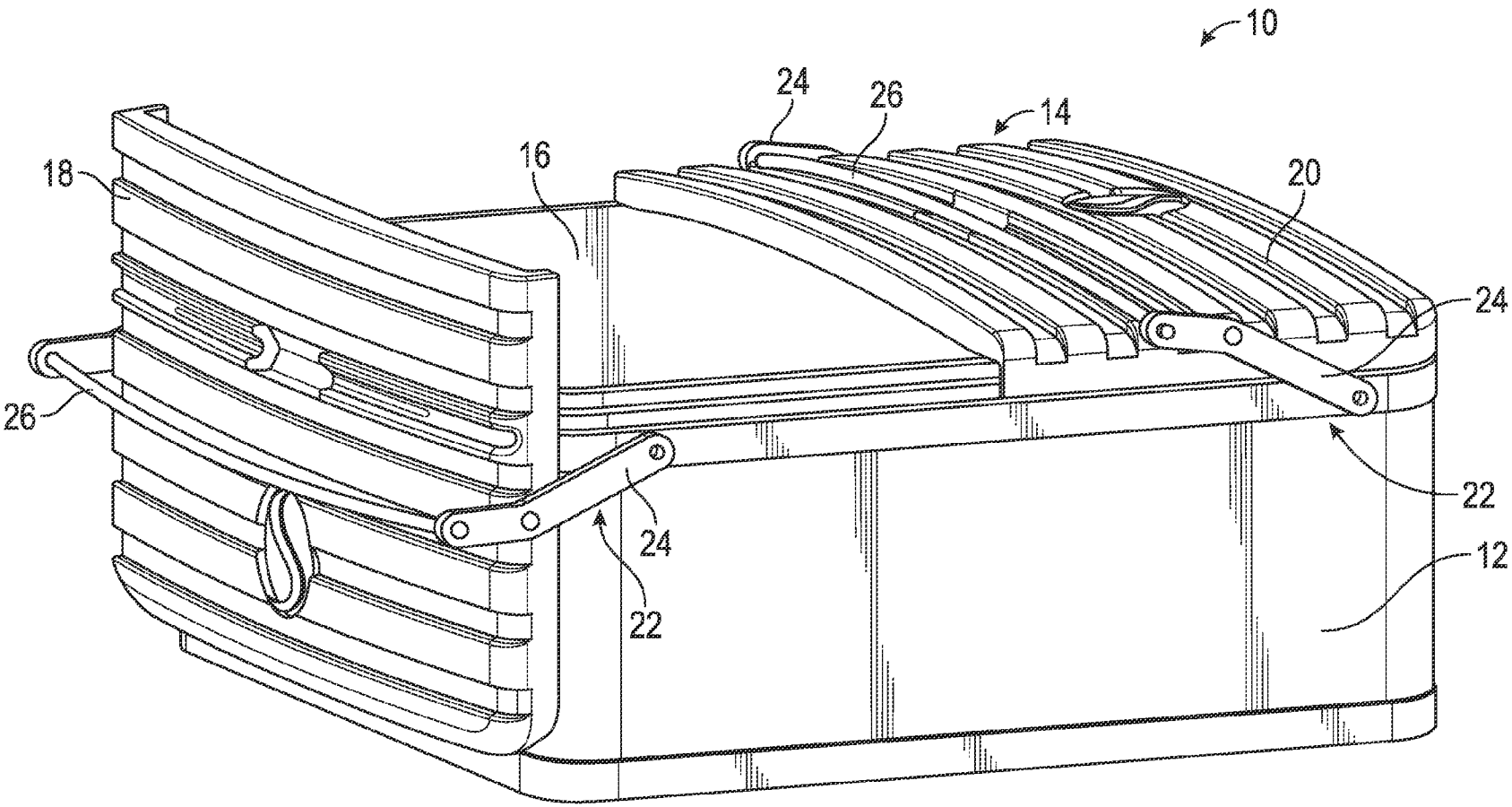
FIG. 2 is a perspective view of the cover assembly of FIG. 1, illustrating one half of the cover assembly in an uncovered, retracted position.
Figure 3:
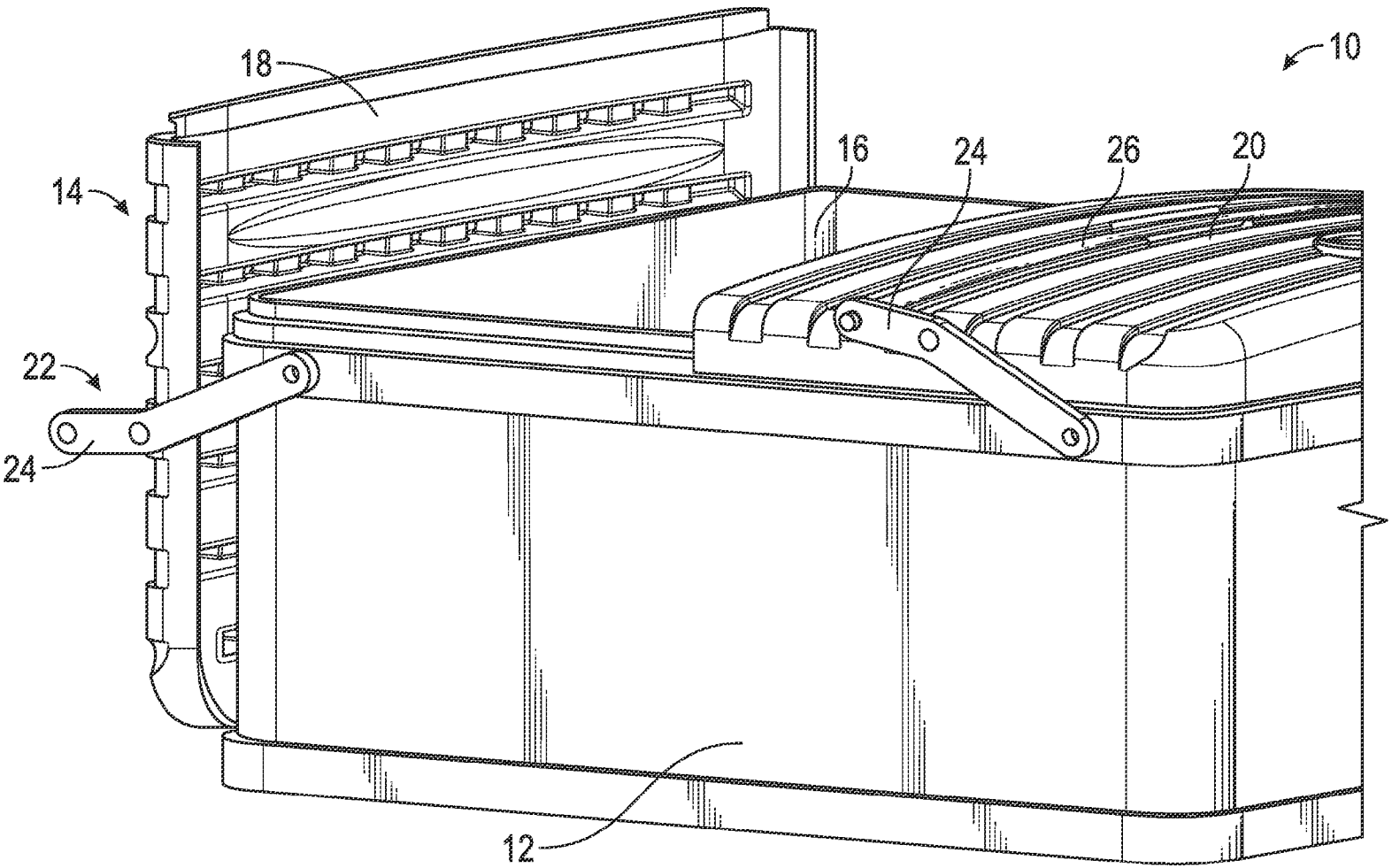
FIG. 3 is an enlarged, perspective view of the spa and cover assembly of FIG. 2.
Figure 4:
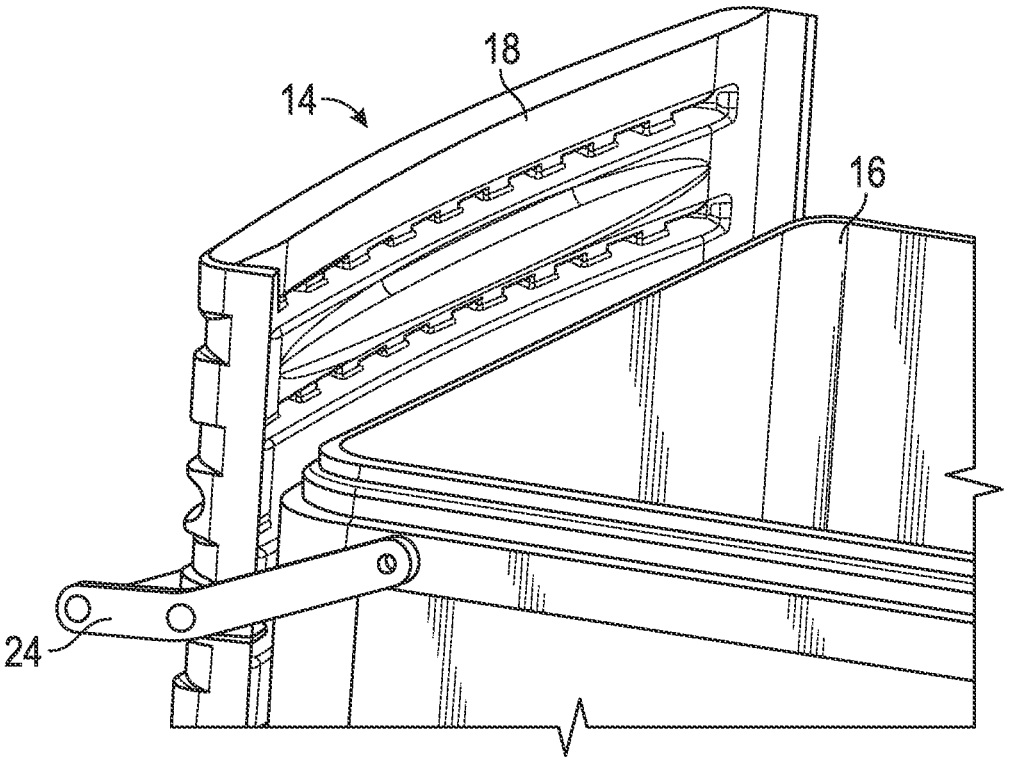
FIG. 4 is another enlarged, perspective view of the spa and cover assembly of FIG. 2.
Figure 5:
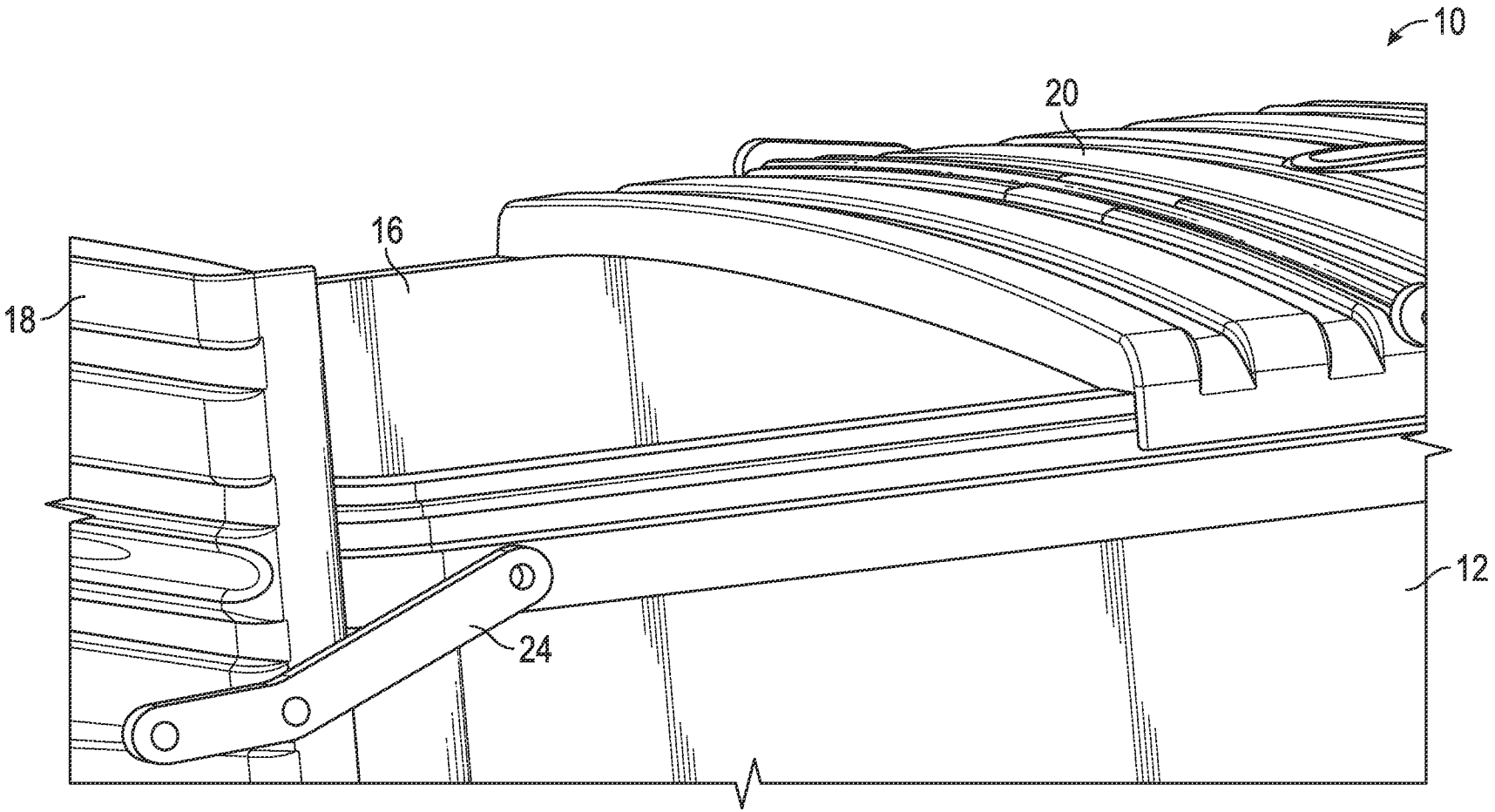
FIG. 5 is another perspective view of the spa and cover assembly of FIG. 2.

In use, to uncover the spa 10, a user grasps lifter handle 26 and pulls towards the side of the spa 10 until the cover member 18, 20 assumes the vertical position adjacent a side of the spa 10, as best illustrated by cover member 18 in FIG. 2. In this position, the cover members 18, 20 may be utilized as towel racks. As will be readily appreciated, to cover the spa, a user grasps lifter handle 26 and pulls upwards until the cover members 18, 20 translate over the top of the spa and come to rest atop the shell 16.

Figure 6:
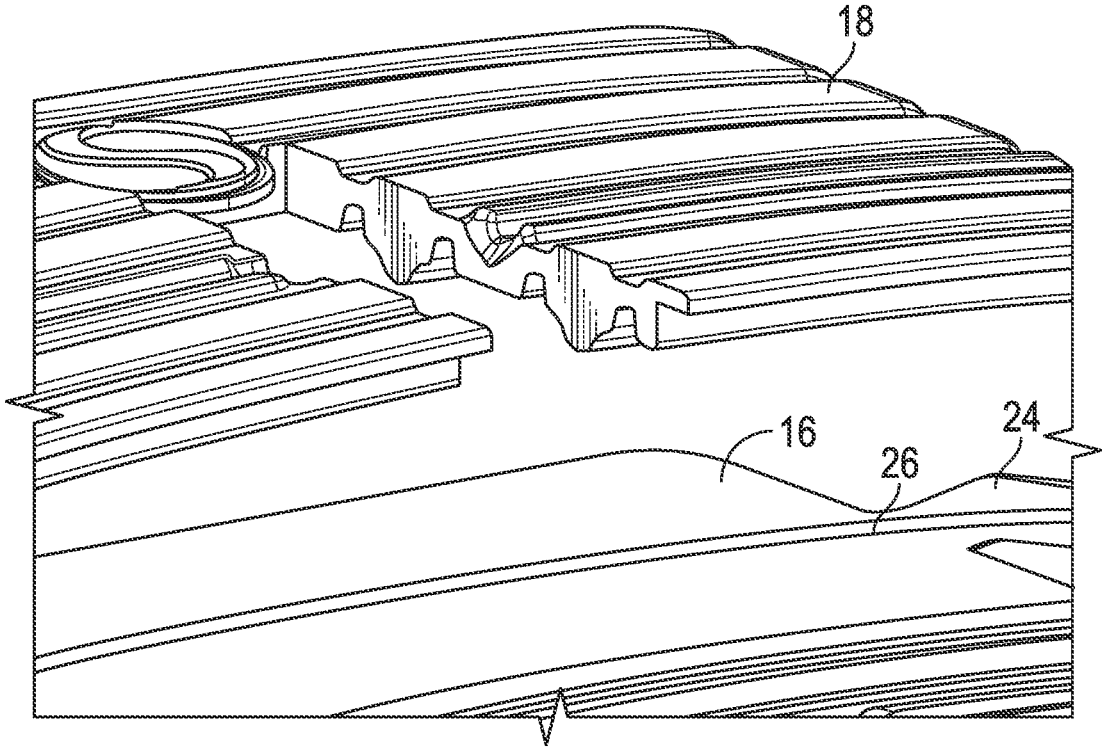
FIG. 6 is an exploded, perspective view of a portion of the spa and cover assembly of FIG. 1.
Figure 7:
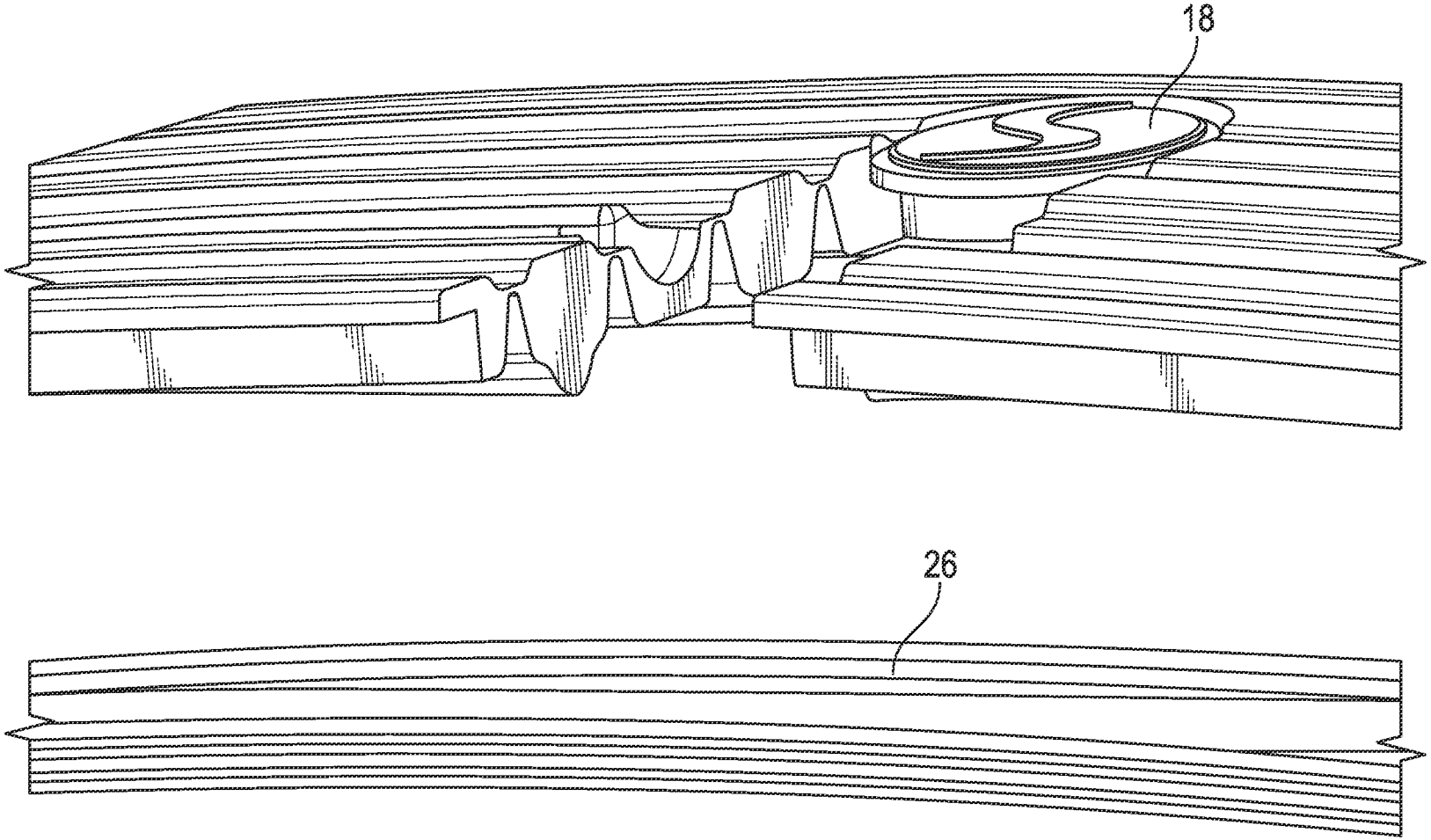
FIG. 7 is another exploded, perspective view of a portion of the spa and cover assembly of FIG. 1.

Importantly, the three point lever design (the angled lifter arms 24 being coupled to the spa cabinet 12 at a one end thereof, to the cover member 18, 20 at an intermediate point along its length, and to the lifter handle 26 at a distal end thereof) results in an easy to open/close spa cover. With further reference to FIGS. 2, 6 and 7, the cover members 18, 20 may take a generally corrugated-like configuration, thereby increasing the structural integrity of the cover 14 such that the cover can support substantial load without buckling. Moreover, the particular configuration of the cover assembly 14 of the present invention is more structurally sound than existing designs, thereby eliminating the potential for damage or breakage.

Turning now to FIGS. 8-14, a spa 100 having a cover assembly 110 according to another embodiment of the present invention is shown. As with the spa 10 described above in connection with FIGS. 1-7, spa 100 may be of any type known in the art and includes a base defining a spa cabinet 112, and an acrylic shell 114 supported by the base. In particular, the spa cabinet 112 serves as the support structure of the spa and may be of any type known in the art, such as framed or sub-frameless. For example, the cabinet 112 may be a sub-frameless spa and may include a pair of end member, a pair of side members, and a base member. While the spa shell 114 is preferably formed from acrylic, it may be formed of any suitable plastic material or other impermeable material suitable for holding water.

Figure 8:
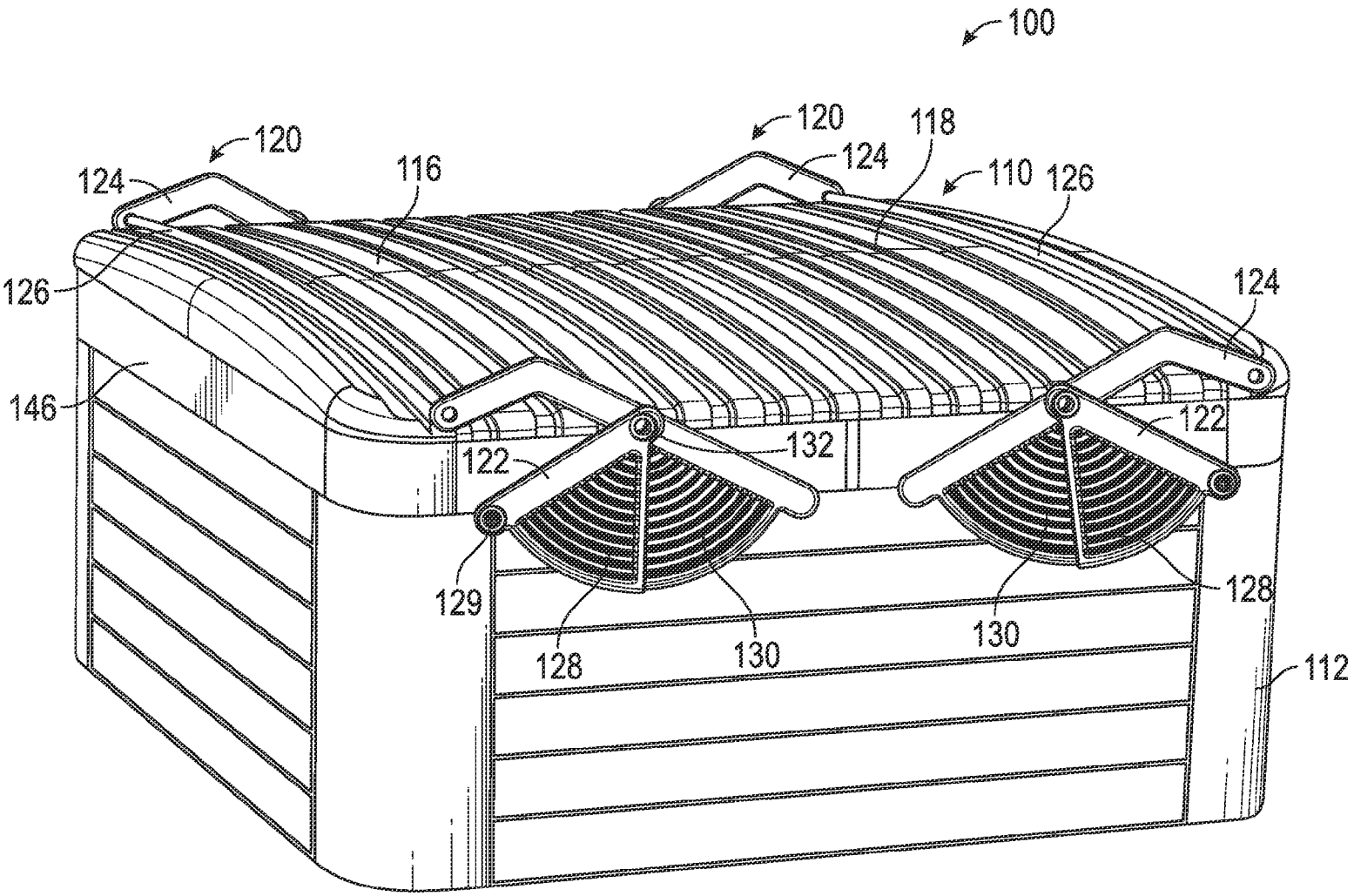
FIG. 8 is a perspective view of a spa having a cover assembly according to another embodiment of the present invention, illustrating the cover assembly in a covered position.
Figure 9:
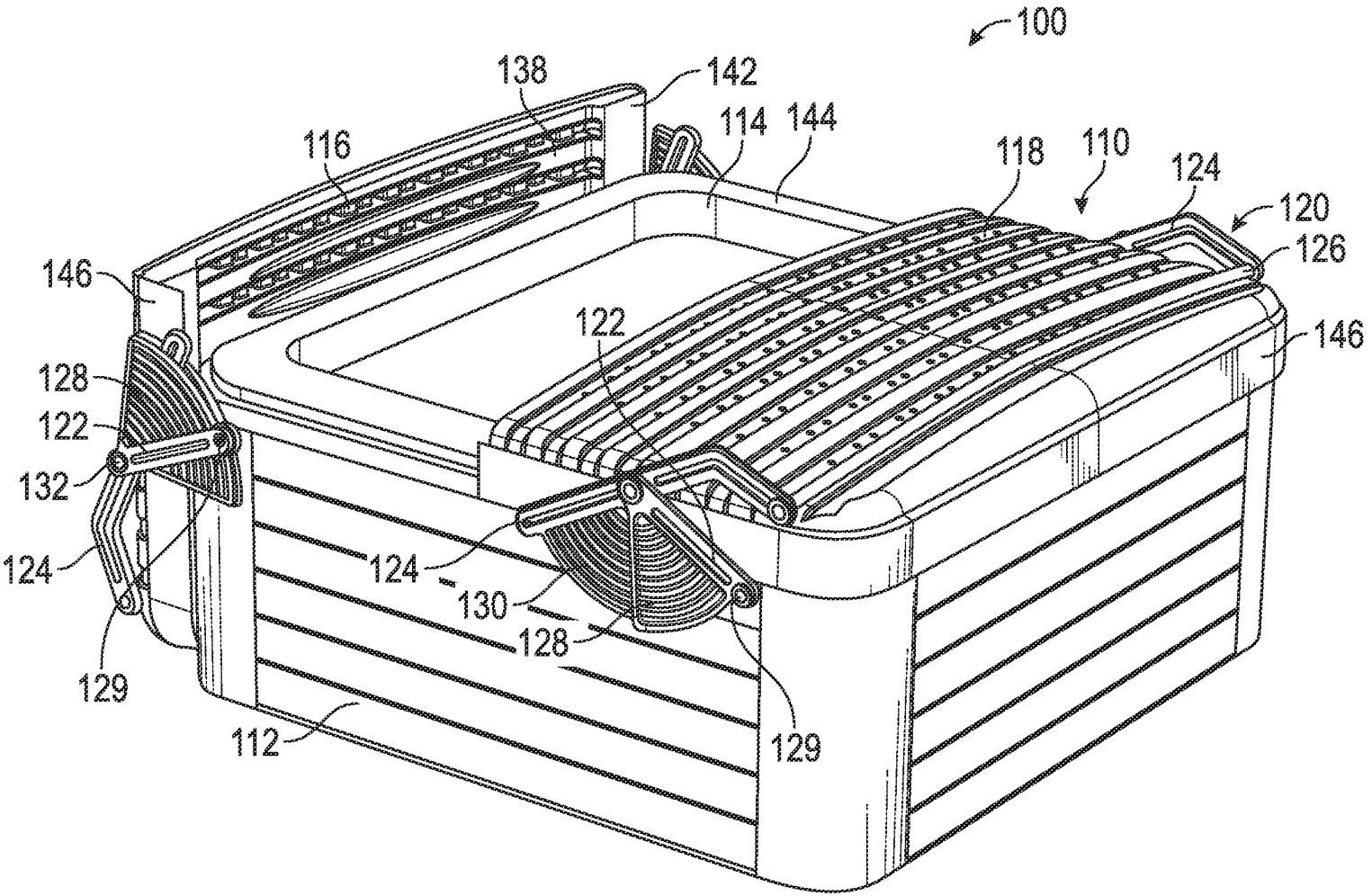
FIG. 9 is a perspective view of the spa and cover assembly of FIG. 8, illustrating one of the cover members of the cover assembly in an open position.

As best shown in FIGS. 8 and 9, the cover assembly 110 according to the present invention includes first and second cover members 116, 118 that are configured to selectively cover first and second halves, respectively, of the top of the spa 100. The cover assembly 110 also includes a lifting mechanism 120 associated with each cover member 116, 118 that allows a user to selectively move the cover members 116, 118 from a covered position, as shown in FIG. 8, to an uncovered position, as illustrated by cover member 116 in FIG. 9, and vice versa.

Each lifting mechanism 120 includes first lifting arms 122 arranged on opposing sides of the spa, second lifting arms 124 also arranged on opposing sides of the spa 100 and pivotally coupled to the first lifting arms 122, and a handle 126 connected to distal ends of the second lifting arms 124. The handle 126 is slightly arcuate in shape and, preferably, mirrors the curvature of the upper surface of the cover members 116, 118.

Figure 10:
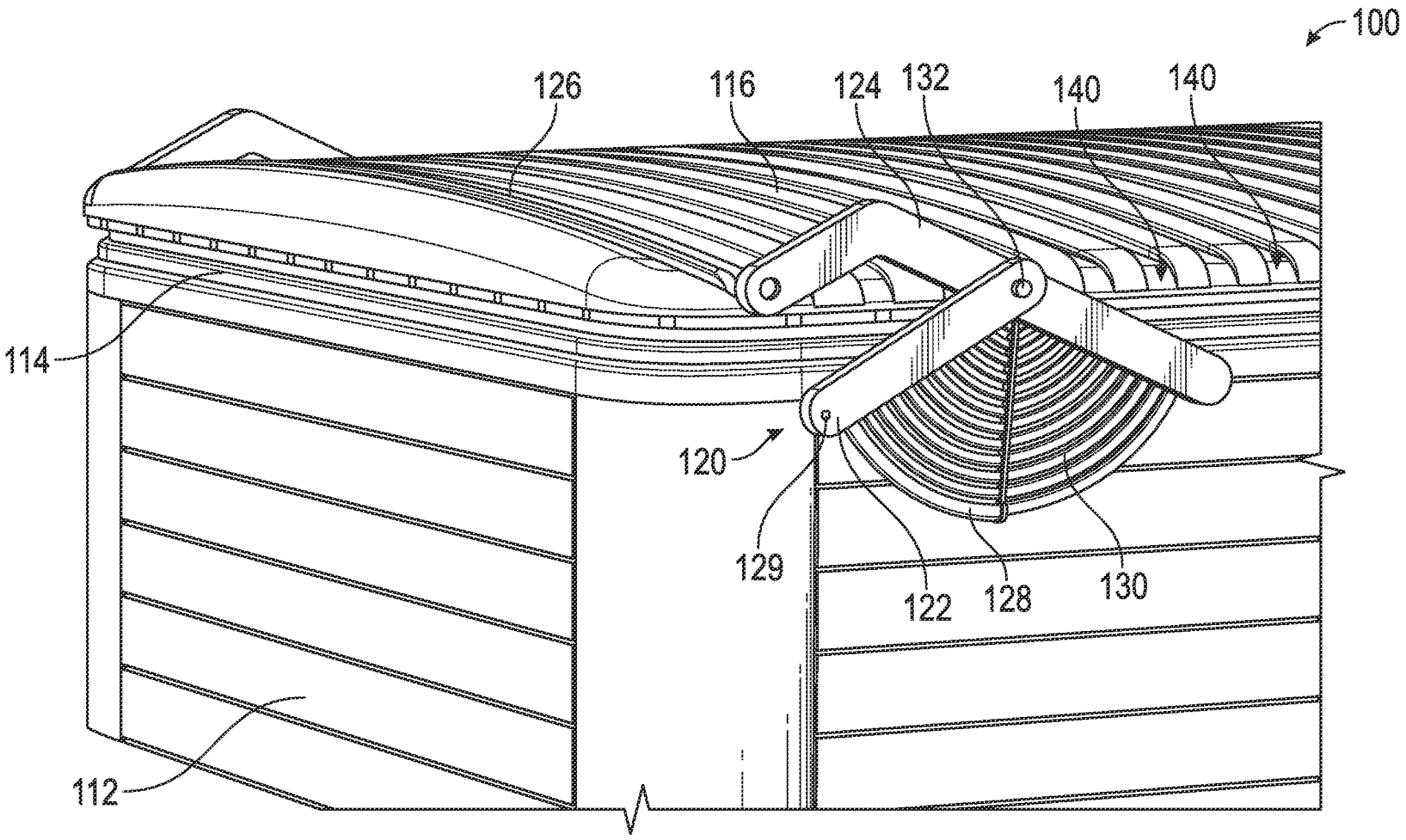
FIG. 10 is an enlarged, perspective view of the spa and cover assembly of FIG. 8, illustrating a lifting mechanism.
Figure 11:
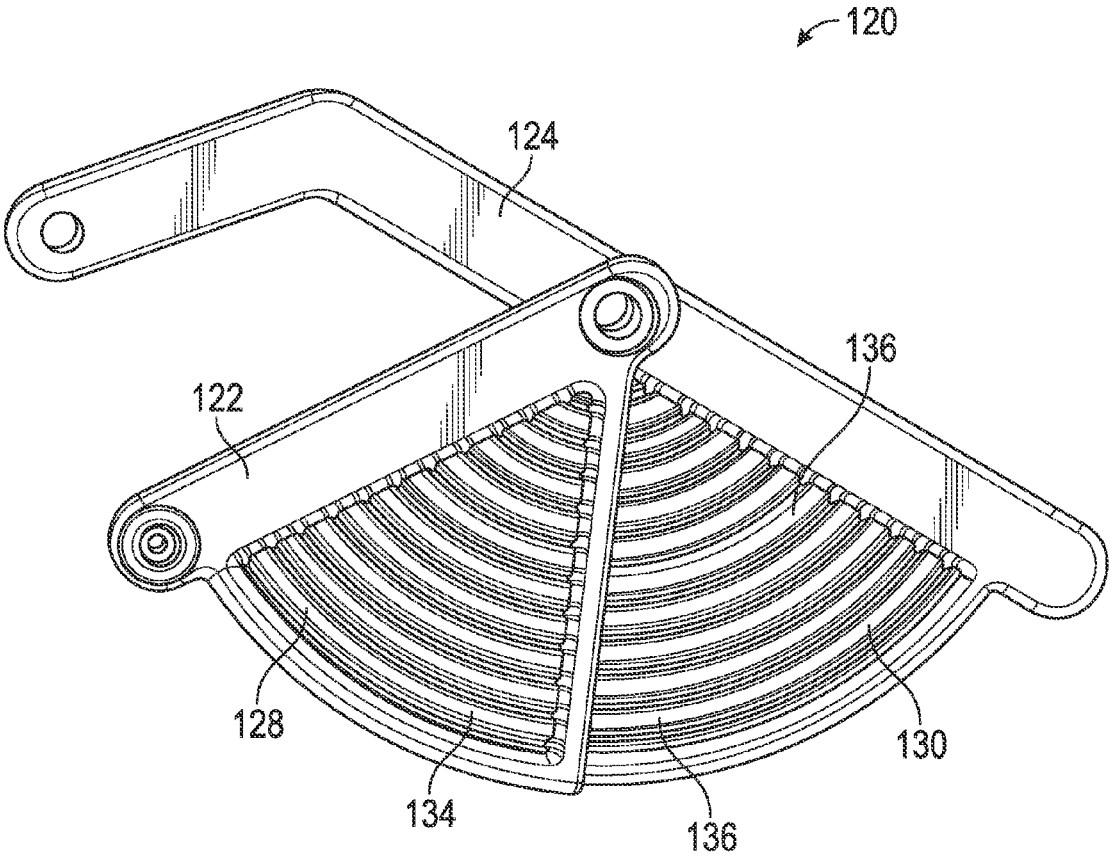
FIG. 11 is an enlarged, perspective view of the lifting mechanism of FIG. 10.
Figure 12:
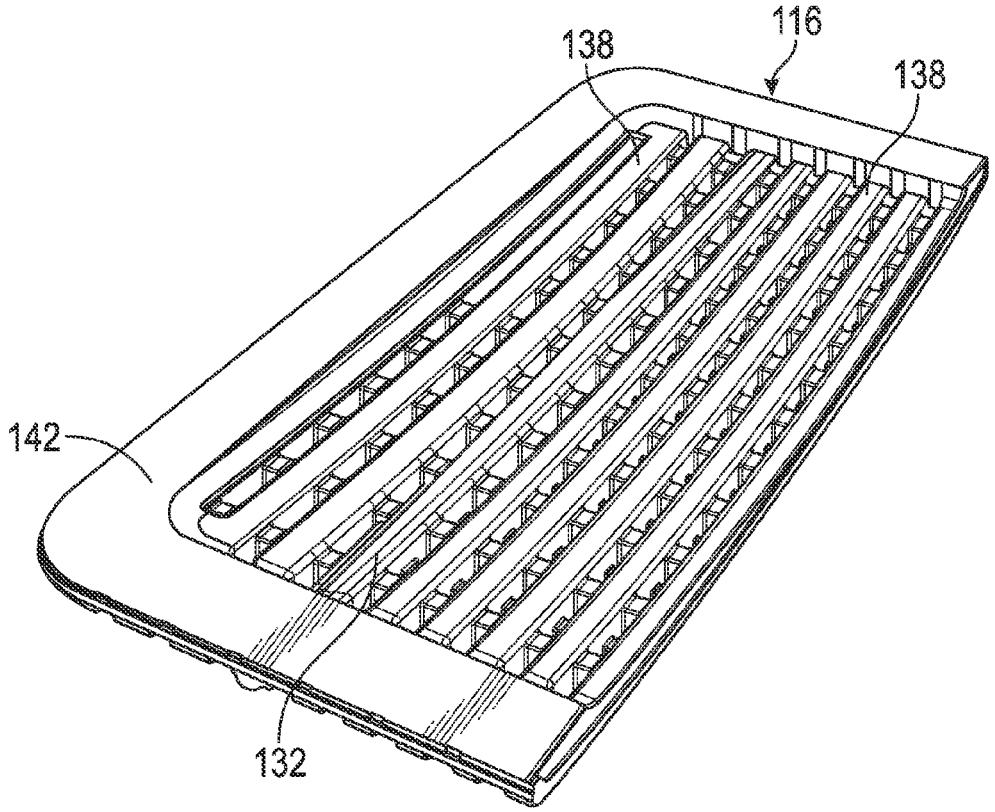
FIG. 12 is a perspective view showing the underside of a cover member of the cover assembly.
Figure 13:
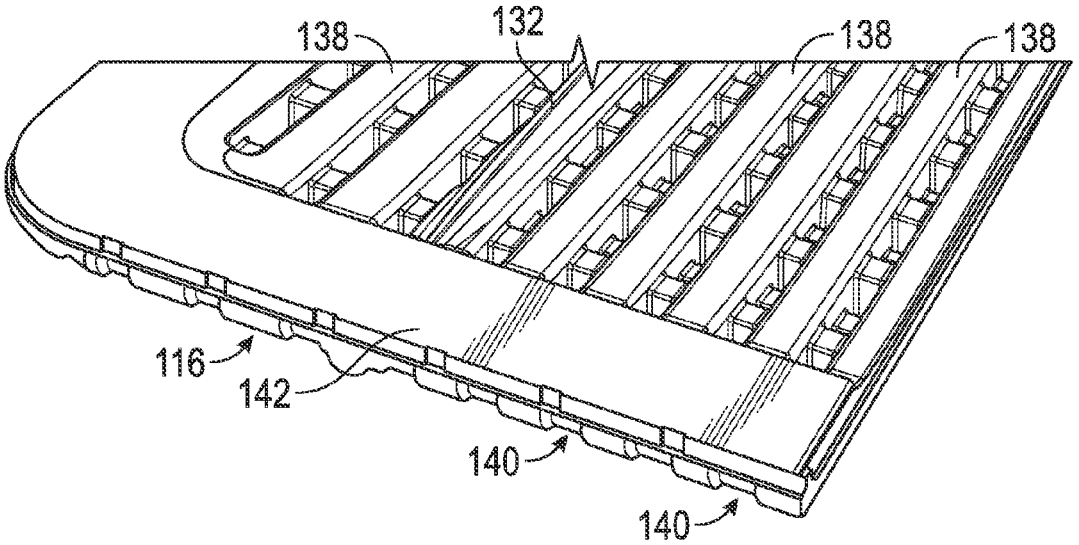
FIG. 13 is an enlarged, detail view of the underside of the cover member of the cover assembly.

As more clearly shown in FIGS. 10 and 11, each first lifting arm 122 has a first guide plate 128 depending therefrom, and each second lifting arm 124 has a second guide plate 130 depending from each second lifting arm 124. A first end of the first lifting arm 122 is pivotally connected to a sidewall of the spa cabinet 112, such as via pin 129. A second end of the first lifting arm 122 is pivotally connected the second lifting arm 124 at its approximate midpoint and to one of the cover members 116, 118 via a pin 132. As illustrated by FIGS. 12 and 13, the pin 132 may extend from one side of the cover member 116, 118 to the other, connecting the opposed lifting mechanisms to one another. As will be readily appreciated, the provision of a unitary pin 132 that extends the width of the cover member 116, 118 adds structural rigidity to the lifting mechanisms 120 and to the cover assembly 110, as a whole.

Importantly, the second lifting arms 124 are substantially L-shaped, which positions the distal ends thereof, and the handle 126 that spans the opposed second lifting arms 124, closer to the side of the spa 100 so that the handle 126 can be easily grasped by a user, as discussed in detail below.

As best shown in FIG. 11, the first guide plate 128 has a plurality of arcuate ridges 134 formed in an outward-facing surface thereof. The provision of these ridges 134 provide arcuate, recessed tracks on the underside (inward-facing side) of the first guide plate 128. Similarly, the second guide plate 130 has a plurality of arcuate ridges 136 formed on an outward-facing surface thereof. These ridges 136 are received the corresponding arcuate tracks formed in the underside of the first guide plate 128 of the first lifting arm 122. This configuration allows the second guide plate 130 to slidably nest with the first guide plate 128 when one of the cover members 116, 118 is moved to the open position illustrated by cover member 116 in FIG. 9.

Importantly, the lifting mechanisms 120 allow the cover members 116, 118 to rotate or pivot about an axis defined by the pin 132. In addition, the cover members 116, 118 may rotate about an axis defined by the point where the first lifting arms 122 are coupled to the spa cabinet 112. In this respect, the cover members 116, 118 each have two points of rotation, which facilitates easy and smooth operation.

In use, to uncover the spa 100, a user grasps handle 126 which is accessible from the side of the spa via the L-shape of the second lifting arms 124 and pulls towards the side of the spa 100, causing the cover member 116, 118 to rotate about pin 132 and pin 129 until the cover member 116, 118 assumes the vertical position adjacent a side of the spa 10, as best illustrated by cover member 116 in FIG. 9. In this position, the second guide plate 130 is substantially nested with the first guide plate 128. Notably, the lifting mechanisms 120 provide a lever action, allowing a user to easily and smoothly remove the cover members 116 without much effort. Moreover, the cooperation between the first and second guide plates 128, 130 (and, in particular, the mating between the ridges of the second guide plate 130 in the recessed tracks in the first guide plate 128) guides movement of the cover members 116, 118 when moved between open and closed positions, respectively. In addition to this, these guide plates 128, 130 enhance the rigidity and integrity of the cover assembly 110, as a whole, ensuring the cover members 116, 118 are only permitted to move along a predefined arc.

As will be readily appreciated, to cover the spa 100, a user grasps lifter handle 126 and pulls upwards, causing the cover member 116, 118 to rotate about pin 129. As a user continues lifting up on the handle 126 and the cover member 116, 118 passes the top edge of spa 100, the cover member 116, 118, while continuing to rotate about pin 129, also rotates to a horizontal position about pin 132 until the cover member 116, 118 comes to rest atop the shell 114. In this position, the guide plates 128, 130 are in a 'fanned out' position, as shown in FIG. 8. Importantly, this lifting mechanism design, having two axes of rotation, results in a cover assembly 110 that is easy to open or close, to a degree heretofore not seen in the art.

In an embodiment, the components of the lifting mechanisms may be manufactured from plastics, although any material known in the art that are of sufficient strength and rigidity to support the weight and rotational movement of the cover members 116, 118, such as metals and the like, may also be utilized without departing from the broader aspects of the present invention.

Figure 14:
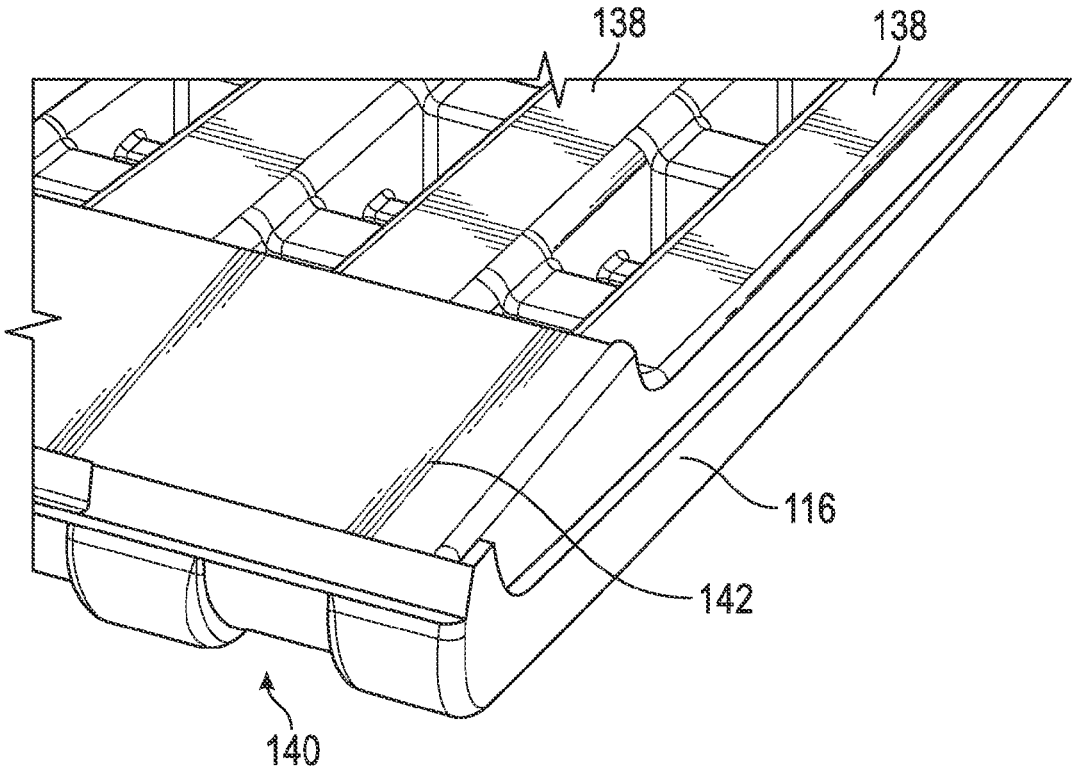
FIG. 14 is another enlarged, detail view of the underside of the cover member.

With reference to FIGS. 12-14, the cover members 116, 118 are double-walled and are preferably formed from rotational molded plastic, and may contain insulating materials to slow the loss of heat from water held within the shell 114. Importantly, the cover members 116, 118 are substantially rigid and are not generally susceptible to bending or flexing during normal use. As shown therein, the cover members 116, 118 preferably include a plurality of reinforcing ribs 138 that span the width of the cover members 116, 118. These ribs 138 add structural rigidity to the cover members 116, 118 and prevent the cover members 116, 118 from caving in due to snow load, small animals or other debris that may fall onto the spa 100. The cover members 116, 118 may, therefore, take a generally corrugated-like configuration, thereby increasing the structural integrity of the cover members 116, 118 such that the cover can support substantial load without buckling.

The cover members 116, 118 also have a peripheral flange 142 on the underside thereof, as best shown in FIGS. 12-14. The peripheral flange 142 is configured to mate with a corresponding flat surface 144 on the shell 114 of the spa 100 to form a seal. This seal between the cover members 116, 118 and the shell 114 of the spa 100 functions to minimize the loss of heat from the water held within the shell 114 when the cover members 116, 118 are in the covered position. With further reference to FIGS. 8 and 9, the cover members 116, 118 are each outfitted with a peripheral skirt 146 that extends from the outer edges of the cover members 116, 118 over a portion of the sidewalls of the cabinet 112. This skirt functions to further inhibit heat loss.

In addition, the cover members 116, 118 also include a plurality of channels 140 formed in a top surface thereof. These channels 140, along with the convex outer curvature of the cover members 116, 118, function to drain rainwater from the top cover members 116, 118. Accordingly, the particular configuration of the cover assembly 110 of the present invention is more structurally sound than existing designs, thereby eliminating the potential for damage or breakage.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A cover assembly for a spa having a base and a shell supported by the base, said cover assembly comprising:

a cover member selectively movable between a covered position and an uncovered position; and a lifting assembly having a first lifting arm pivotally coupled at one end to said base and defining a first pivot point and at another end to said cover member and defining a second pivot point, a second lifting arm pivotally connected to said first lifting arm at said second pivot point, and a handle connected to a distal end of said second lifting arm;

wherein said second lifting arm is generally L-shaped such that a leg of said second lifting arm to which said handle is connected is generally parallel to said first lifting arm when said cover member is in said covered position atop said shell of said spa;

wherein said handle is positioned above said cover member when said cover member is said covered position atop said shell of said spa; and wherein said first and second pivot points provide two axes of rotation for said cover member relative to said base.

2. The cover assembly of claim 1, wherein:

said two axes are vertically and horizontally offset from one another.

3. The cover assembly of claim 2, wherein:

said first lifting arm has a first depending guide plate and said second lifting arm has a second depending guide plate; and wherein said cover member is rotatable about said first pivot point and said second pivot point between said covered position, in which said cover member rests atop said shell, and said uncovered position, in which said cover member is oriented generally vertically adjacent a sidewall of said base.

4. The cover assembly of claim 3, wherein:

said second guide plate includes a plurality of ridges that are received in a plurality of corresponding recessed tracks in said first guide plate.

5. The cover assembly of claim 4, wherein:

said ridges are arcuate in shape; and said corresponding recessed tracks are arcuate in shape.

6. The cover assembly of claim 3, further comprising:

another lifting assembly positioned on an opposing side of said base from said lifting assembly, said handle extending between said lifting assembly and said another lifting assembly.

7. The cover assembly of claim 1, wherein:

said cover member has a substantially convex outer surface and includes a plurality of channels formed in said outer surface; and wherein said handle is received in one of said plurality of channels when said cover member is in said covered position.

8. The cover assembly of claim 1, wherein:

said cover member is double-walled and is formed from rotational molded plastic.

9. A spa, comprising:

a base;

a shell supported by said base and configured to hold a volume of liquid;

a cover member selectively movable between a covered position atop said shell and an uncovered position adjacent to a sidewall of said base; and a lifting mechanism having a first lifting arm pivotally coupled at one end to said base and defining a first pivot point and at another end to said cover member and defining a second pivot point, a second lifting arm pivotally connected to said first lifting arm at said second pivot point, and a handle connected to a distal end of said second lifting arm;

wherein said second lifting arm is generally L-shaped such that a leg of said second lifting arm to which said handle is connected is generally parallel to said first lifting arm when said cover member is in said covered position atop said shell of said spa;

wherein said handle is positioned above said cover member when said cover member is in said covered position atop said shell of said spa; and wherein said first and second pivot points provide two axes of rotation for said cover member relative to said base for selectively moving said cover member between said covered position and said uncovered position.

10. The spa of claim 9, wherein:

said two axes are vertically and horizontally offset from one another.

11. The spa of claim 10, wherein:

said first lifting arm has a first depending guide plate and said second lifting arm has a second depending guide plate; and wherein said cover member is rotatable about said first pivot point and said second pivot point between said covered position, in which said cover member rests atop said shell, and said uncovered position, in which said cover member is oriented generally vertically adjacent said sidewall of said base.

12. The spa of claim 11, wherein:

said second guide plate includes a plurality of ridges that are received in a plurality of corresponding recessed tracks in said first guide plate.

13. The spa of claim 12, wherein:

said ridges are arcuate in shape; and said corresponding recessed tracks are arcuate in shape.

14. The spa of claim 9, wherein:

said cover member has a substantially convex outer surface and includes a plurality of channels formed in said outer surface; and wherein said handle is received in one of said plurality of channels when said cover member is in said covered position.

15. A method of covering and uncovering a spa having a base and a shell supported by said base, said method comprising the steps of:

providing a cover member atop said shell; and equipping said cover member with a lifting mechanism having a first lifting arm pivotally coupled at one end to said base and defining a first pivot point and at another end to said cover member and defining a second pivot point, a second lifting arm pivotally connected to said first lifting arm at said second pivot point, and a handle connected to a distal end of said second lifting arm;

wherein said second lifting arm is generally L-shaped such that a leg of said second lifting arm to which said handle is connected is generally parallel to said first lifting arm when said cover member is in a covered position atop said shell of said spa;

wherein said handle is positioned above said cover member when said cover member is in said covered position atop said shell of said spa; and wherein said first and second pivot points provide two axes of rotation for said cover member relative to said base for selectively moving said cover member between said covered position atop said shell and an uncovered position adjacent to a sidewall of said base.

16. The method according to claim 15, wherein:

said first lifting arm has a first depending guide plate and said second lifting arm has a second depending guide plate; and wherein said cover member is rotatable about said first pivot point and said second pivot point between said covered position and said uncovered position.

17. The spa of claim 16, wherein:

said second guide plate includes a plurality of ridges that are received in a plurality of corresponding recessed tracks in said first guide plate.

* * * * *